US007891904B2

(12) United States Patent
Stadler

(10) Patent No.: US 7,891,904 B2
(45) Date of Patent: Feb. 22, 2011

(54) MANHOLE COVER STOP MECHANISM

(76) Inventor: David Stadler, 28421 Santa Barbara, Lathrup Village, MI (US) 48076

( * ) Notice: Subject to any disclaimer, the term of this patent is extended or adjusted under 35 U.S.C. 154(b) by 124 days.

(21) Appl. No.: 12/482,830

(22) Filed: Jun. 11, 2009

(65) Prior Publication Data

US 2010/0028077 A1 Feb. 4, 2010

Related U.S. Application Data

(60) Continuation-in-part of application No. 12/357,525, filed on Jan. 22, 2009, now Pat. No. 7,712,995, which is a division of application No. 11/761,711, filed on Jun. 12, 2007, now Pat. No. 7,484,908.

(60) Provisional application No. 60/921,975, filed on Apr. 6, 2007, provisional application No. 60/889,553, filed on Feb. 13, 2007, provisional application No. 60/812,757, filed on Jun. 12, 2006, provisional application No. 61/131,754, filed on Jun. 11, 2008.

(51) Int. Cl.
*E02D 29/14* (2006.01)

(52) U.S. Cl. ..... 404/25; 52/19; 52/20

(58) Field of Classification Search ..... 404/25; 52/19, 20

See application file for complete search history.

(56) References Cited

U.S. PATENT DOCUMENTS

| | | | | | |
|---|---|---|---|---|---|
| 822,562 | A * | 6/1906 | Tucker | 292/37 |
| 2,363,567 | A * | 11/1944 | Blakeman | 292/6 |
| 3,921,494 | A * | 11/1975 | Coe | 411/344 |
| 4,461,597 | A * | 7/1984 | Laurin | 404/25 |
| 4,902,165 | A * | 2/1990 | Embree | 404/25 |
| 5,324,135 | A * | 6/1994 | Smith | 404/25 |
| 6,735,992 | B2 * | 5/2004 | Hauer et al. | 70/167 |
| 7,243,515 | B2 * | 7/2007 | Meyer | 70/269 |
| 7,484,908 | B2 | 2/2009 | Stadler | |

* cited by examiner

*Primary Examiner*—Raymond W Addie
(74) *Attorney, Agent, or Firm*—John R. Benefiel

(57) ABSTRACT

A stop mechanism advantageously combined with a manhole cover includes a holder body having a passage which slidably receives a stop member able to be cammed in and out upon advance or retraction of a threaded drive member having an enlarged tip engaged with a down sloping channel formed in the stop member. Upper sides of the channel engage the tip upon reversal of the drive member to cam the stop member back into the holder body. The stop member when extends prevents removal of the cover from being blown completely free of the manhole vault structure in the event of an explosion.

15 Claims, 4 Drawing Sheets

MANHOLE COVER STOP MECHANISM

CROSS REFERENCE TO RELATED APPLICATIONS

This application is a continuation in part of U.S. application Ser. No. 12/357,525 filed on Jan. 22, 2009 now U.S. Pat. No. 7,712,995 which is a division of U.S. patent application Ser. No. 11/761,711 filed on Jun. 12, 2007, now U.S. Pat. No. 7,484,908. which claims benefit of U.S. provisional patent application No. 60/921,975 filed on Apr. 6, 2007 and U.S. provisional patent application No. 60/889,553 filed on Feb. 13, 2007 and No. 60/812,757 filed on Jun. 12, 2006. This application also claims benefit of U.S. provisional application No. 61/131,754 filed on Jun. 11, 2008.

BACKGROUND OF THE INVENTION

The present invention concerns retractable stop mechanisms and more particularly such mechanisms for preventing unauthorized removal of covers for catch basins and manholes installed in roadways for access to utilities, i.e., water, gas, communications, electricity, etc. These covers are provided in order to keep out debris but also to present a supporting surface for pedestrians and vehicles on the surrounding roadway surface. If the covers are removed by thieves or vandals, the opening to a catch basin or manhole presents severe hazard to vehicles and pedestrian traffic. Removal of these covers by vandals or scavengers has become an increasing problem which has created an urgent need for some means for preventing unauthorized removal of the covers. In instances where there are no existing means incorporated in existing catch basin and manhole covers, providing a simple retrofit to existing covers with a securing means is highly desirable. Such devices should preferably be designed to withstand traffic and weather and the efforts of vandals, thieves or terrorists to remove them. The large numbers involved require a simple installation method to minimize labor costs. The securing means should preferably not present an obstruction in the roadway, particularly for snow plows, nor a tripping hazard to pedestrians.

At the same time, any such means should be reliable in operation even after many years of exposure to the elements.

The present inventor has heretofore invented a retractable stop mechanism which is designed to allow a limited movement of a manhole cover out of the manhole vault structure to when an explosion occurs in the manhole space but prevents the cover from being blown free so as to avoid the hazard presented by the manhole cover when it falls back to the surface while still allowing escape of the gases so as to minimize damage to the vault structure. The stop mechanism also prevents complete removal of the manhole cover to function as a security retention for the cover. This is described in detail in U.S. Pat. No. 7,484,908 incorporated herein by reference. That mechanism relies on a spring return to retract the stop member, but due to the possibility of corrosion, causing increased resistance to movement of the parts of the mechanism, it is desirable to not rely on a spring operation of the retraction release as the mechanism since it may be exposed to the elements for many years.

It is an object of the present invention to provide a simple but selectively and reliably releasable stop mechanism for manhole covers and other structures which can resist attempts at unauthorized removal of the cover, but which is easily operated by an authorized person even after many years in service, which can be readily installed on existing covers, and does not present an obstruction to traffic.

It is a further object to provide a releasable cover stop mechanism advantageously arranged to allow a manhole cover to rise up out of a manhole cover frame to a limited extent for venting gases created in an explosion as described and claimed in U.S. Pat. No. 7,484,908.

SUMMARY OF THE INVENTION

The above recited objects and other objects which will become apparent to those skilled in the art upon a reading of the following specification and claims is achieved by a rugged tamper resist stop mechanism in accordance with the present invention which prevents complete removal of a cover from a manhole opening, which is adapted to be mounted on the underside of the cover. A holder body is provided to slidably mount an elongated stop member. A headed drive member which may be threaded comprised of a threaded bolt is received into a threaded bore in the holder body, wherein it may be advanced or retracted by being rotated in the threaded bore. An enlarged bulbous tip on the drive member is engageable with surfaces defining a downwardly sloping channel formed into the top of the stop member with both advance and return movement so as to produce a two-way camming action to advance or retract the stop member to either an extended position with one end protruding from the holder body, or to a retracted position with the one end retracted into the holder body.

The holder body is formed with an internal passage slidably receiving the stop member, which may be of a generally cylindrical shape, and the downwardly angled channel formed therein receives the enlarged tip of the drive member. The channel is preferably defined by rounded sides and a rounded bottom surface, the sides slightly converging towards each other at the upper ends thereof to form a slot therebetween at the top, narrower than the drive member tip which is slidable in the widest point of the channel. The slot is sized to slidably receive a shaft portion of the drive Member adjacent the tip. When the drive member is advanced into the threaded bore, by engagement of a special tool with a uniquely shaped security head on the drive member, the tip of the drive member is received within a wider entry portion of the channel and is engaged with the rounded bottom surface defining in part the downwardly angled channel in the stop member, thereby camming the stop member from a retracted position within the body into an extended position with one end protruding from the holder body.

In this position, the protruding one end of the locking member may be aligned with a fixed abutment located above the protruding end and preventing complete removal of the cover, although able to move up to a limited extent due to a clearance between the stop member one end and the abutment which creates an annular gap allowing venting of the gases created in an explosion.

When the drive member is rotated in the opposite direction so as to be backed out of the bore in the holder body, upper surfaces on the enlarged tip of the drive member engage the inside of the convergent portion of the channel sides to exert an upward camming force on the stop member positively acting on the stop member to be moved in the opposite direction, thereby retracting the stop member so that the one end of the stop member is moved back into the holder body.

The cover is then able to be completely removed from the opening without interference from the stop member.

The stop mechanism is advantageously combined with a manhole cover to prevent the cover from being completely blown free of a surface manhole vault structure or to be removed by an unauthorized person.

DETAILED DESCRIPTION

Figure 1:
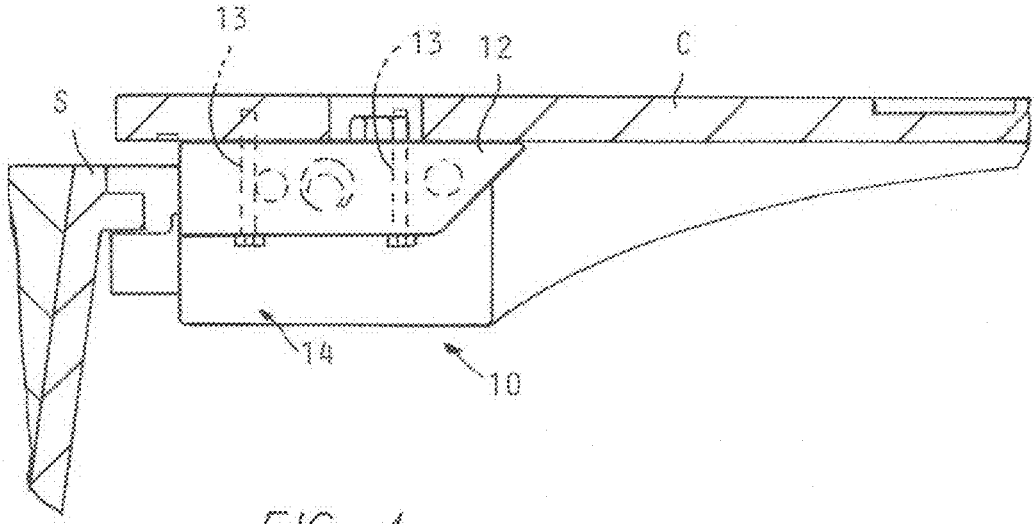
FIG. 1 is a side elevational view of a stop mechanism according to the invention with fragmentary portions of a manhole cover and adjacent manhole vault structure shown in section with the cover shown in an elevated state and being restrained from further upward movement by a stop member included in the stop mechanism engaging a fixed abutment.
Figure 2:
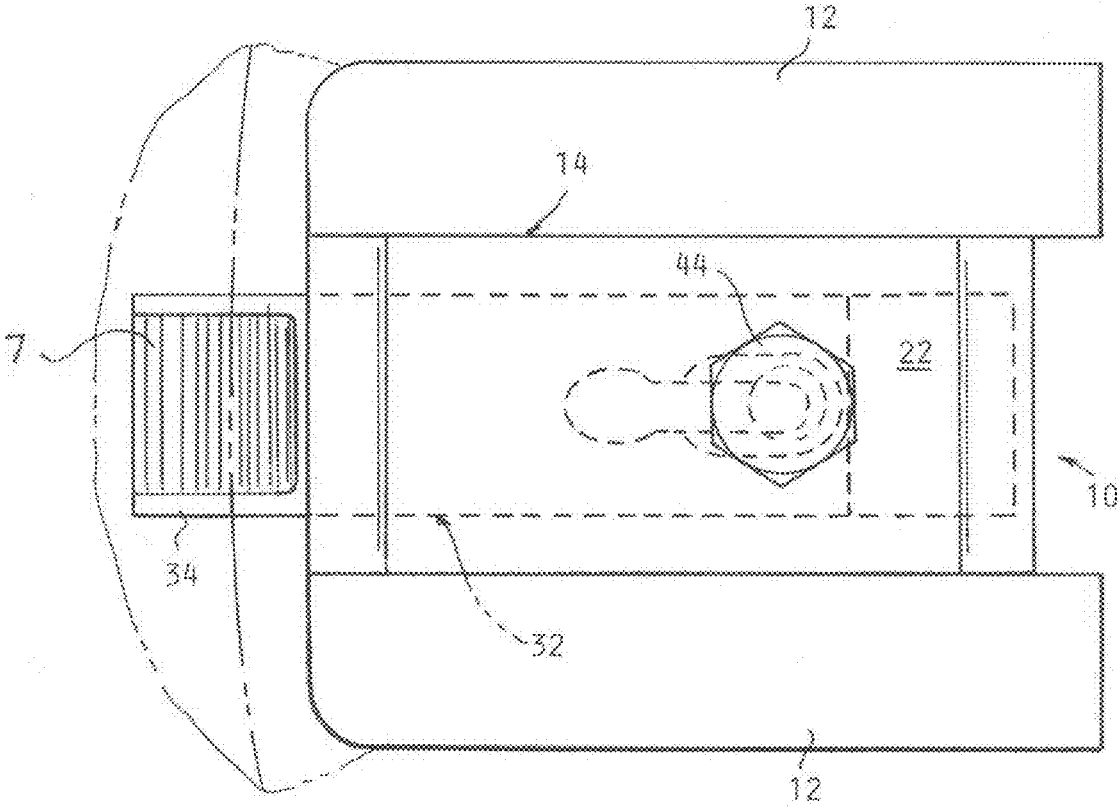
FIG. 2 is an enlarged top view of the stop mechanism shown in FIG. 1 with one end of a retractable stop member shown extended to restrain the cover from moving completely free from the surrounding vault structure shown in fragmentary form and in broken lines.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

As shown in the drawing Figures, an embodiment of a stop mechanism 10 according to the invention is shown, suspended between a pair of side rails 12 attached to the underside of the cover C with bolts 13 received in the threaded holes in the underside of the cover C in a generally similar manner as the mechanism shown in U.S. Pat. No. 7,484,908, incorporated herein by reference. The stop mechanism 10 includes a holder body 14, having a longitudinal passage 15 is formed therein. The holder body 14 may be attached to the underside of a manhole cover C fit into an opening in a manhole vault and cover frame structure S, captured between the pair of side rails 12 by a pair of rods 16A, 16B passing completely through holes in the holder body with opposite ends received in respective blind holes 18A, 18B in the adjacent inside faces of the rails 12.

This general arrangement is shown in U.S. Pat. No. 7,484,908 and includes a shear pin 19 which when fractured under a predetermined stress level allows a limited pivoting down of the holder body 14 as described further below.

A threaded bore 20 extends into the top of the holder body 14 intersecting a lengthwise passage 22. The passage 22, which may be lined with bronze bushing 29, is open to the left but closed on the right as shown. A small vent hole bore 26 may be formed venting the passage 22.

A recess 28 is also preferably formed into the bottom of the passage 22, the recess 28 aligned with threaded bore 20 and may be generally cylindrical with a rounded bottom.

Figure 3:
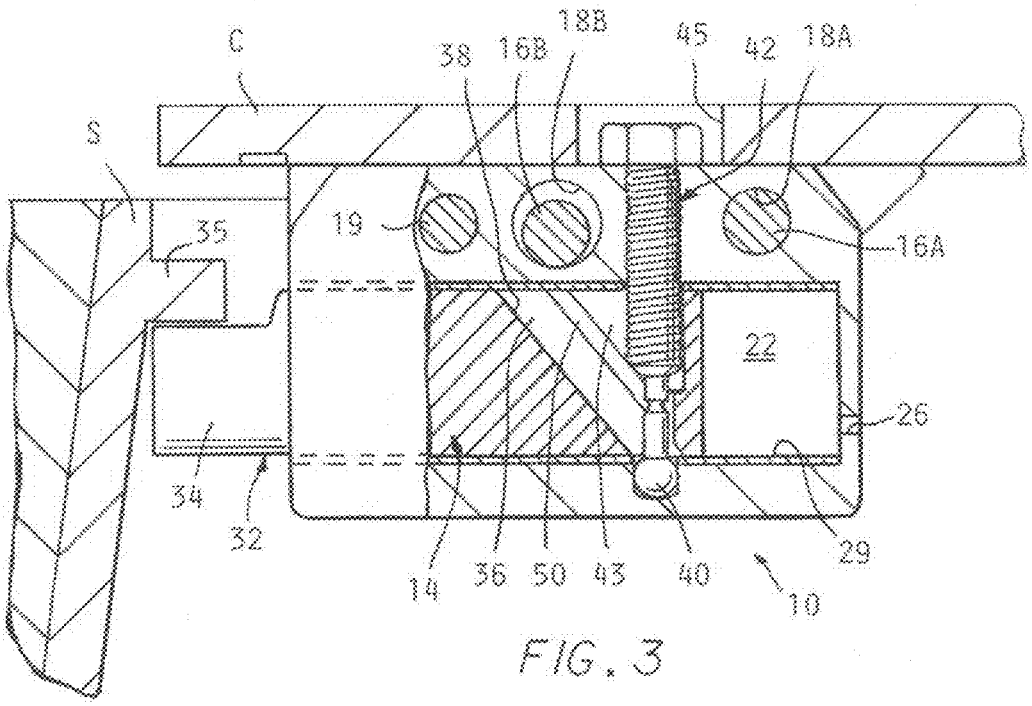
FIG. 3 is a side view of the stop mechanism shown in FIG. 1 in partial section with the stop member in the extended position and engaged with a fixed abutment on the vault structure after the cover has risen to a limited extent.
Figure 4:
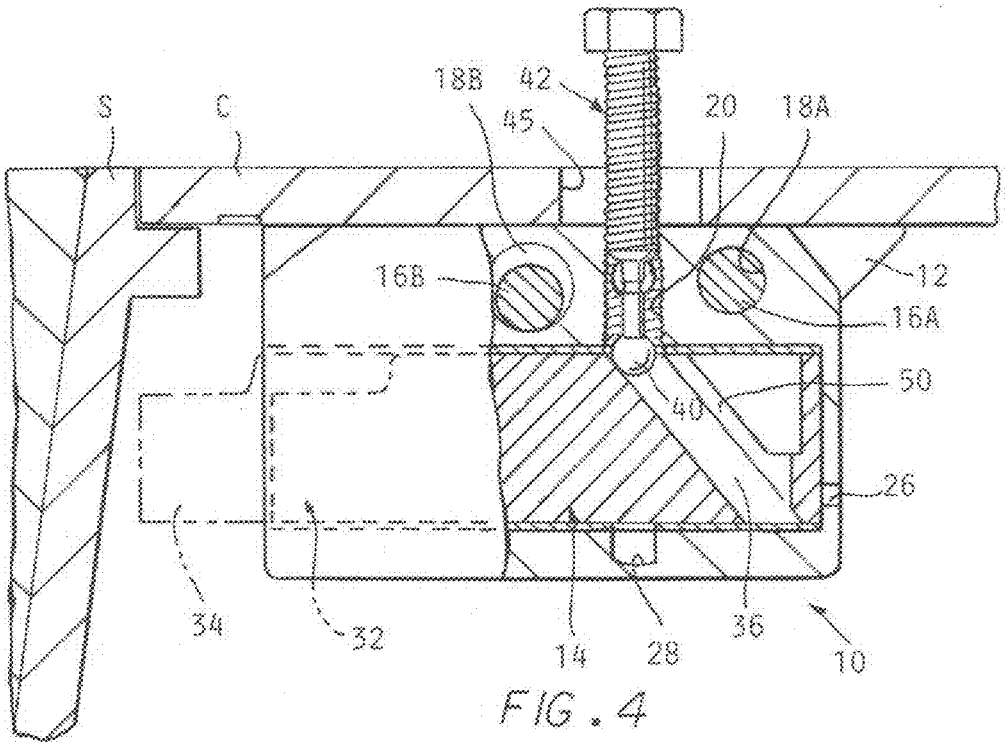
FIG. 4 is a partially sectional side view of the stop mechanism shown in FIGS. 1-3 with the stop member shown retracted but with the outline of the stop member indicated in broken lines in the extended position and the cover at rest recessed to in the manhole opening.

A stop member 30 is slidably received in the passage 22 and may be selectively positioned with one end 32 protruding from the holder body 14 (FIG. 3) or retracted therein (FIG. 4). That is, the stop member 30 is slidably movable from a retracted position to an extended position to the left (FIGS. 1, 3) within the holder body 14. The one end 32 of stop member 30 may be flattened to better engage the sides of a fixed stop structure F formed on the vault structure 5. Grooves 34 may also be provided (FIG. 7) extending across the flattened top of the one end 32 of the stop member 30. The stop member 30 has formed therein a down sloping channel 36 extended in from the top surface and passing entirely through the bottom side of the stop member 30.

The channel 36 is partially circular in section and has a slightly enlarged entry 38 formed at the entrance at the top end in order to be able to receive an enlarged bulbous tip 40 on the bottom end of a drive member 42, aligned therewith in the retracted position shown in FIG. 4.

Figure 9:
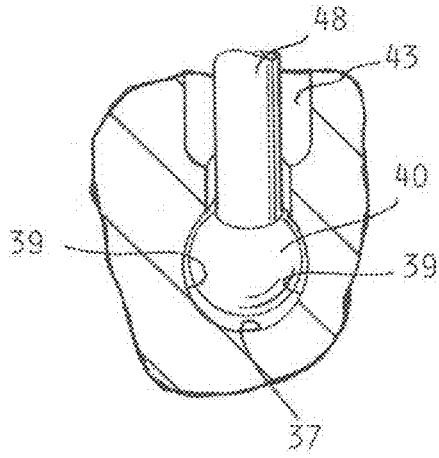
FIG. 9 is a fragmentary transverse sectional view of the stop member shown in FIG. 7 looking down the channel formed therein with the tip of the drive member disposed therein.

The channel 36 is defined in part by a rounded bottom surface 37 (FIG. 9) engageable with the rounded bottom of the tip 40 of the drive member 42

The drive member 42 is also formed with a specially shaped head 44 engageable with a mating specially shaped driving tool such as a socket (not shown). The head 44 may be designed with a unique shape (not shown in the drawing), so that a special tool containing a socket having a shape mating with the head 44 complementary thereto is required to rotate the member 42 in order to provide security by preventing engagement of the head 44 with standard tools. The head 44 is accessed through an opening 45 in the cover C in which the head 44 is recessed.

The drive member 42 is also formed with a threaded shaft main body 46, and a narrowed intermediate non-threaded shaft section 48, connecting the tip 40, the tip 40 having a greater diameter than the diameter of the intermediate shaft section 48.

The main body 44 threadedly engages the threaded bore 20. As the drive member 42 is continued to be rotated into threaded bore 20, the tip 40 is received within the channel 36 which as noted has a slightly enlarged entry 38 sized to freely accept the tip 40. As the drive member 42 continues to be rotated so as to be advanced along bore 20, the tip 40 engages the down sloping bottom surface 37 of channel 36, thereby camming the stop member 30 towards the fully extended position reached as the drive member 42 is advanced to the bottom of the channel 36.

Further advance of the drive member 42 causes the tip 46 to be received within recess 28, the drive member 42 thereby firmly holding the stop member 30 in place within the holder body 14.

Stated another way, the drive member 42 exerts a camming force causing extension movement of the stop member by engagement with the sloping bottom 37 of the channel 36 with the tip 46. The stop member 30 is thereby advanced to the left upon continued descent of the drive member 42 in engagement with the bottom surface of the channel 36 thereby pushing the stop member 30 to the left into its extended position with one end 32 fully protruding from the holder body 14 as seen in FIG. 4.

The one end 32 of stop member 30 when extended is aligned below fixed stop F on the surrounding vault structure S to be restrained thereby, preventing complete escape or removal of the cover C.

Figure 7:
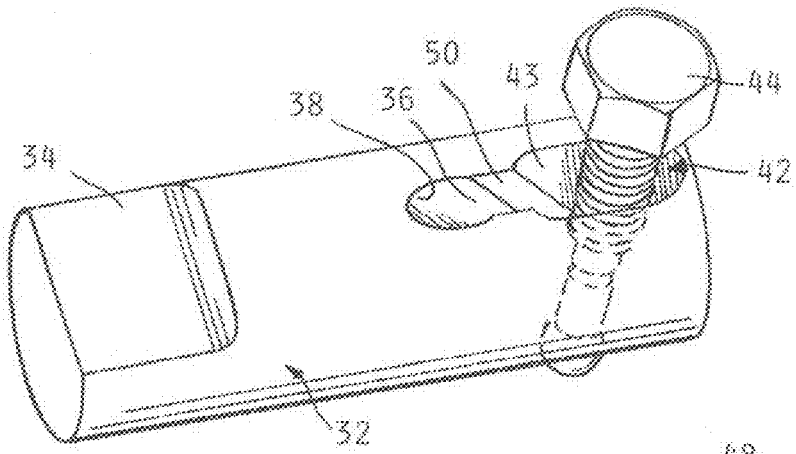
FIG. 7 is a pictorial view of the stop member included in the stop mechanism shown showing the drive member in position with its tip in engagement therewith.
Figure 8:
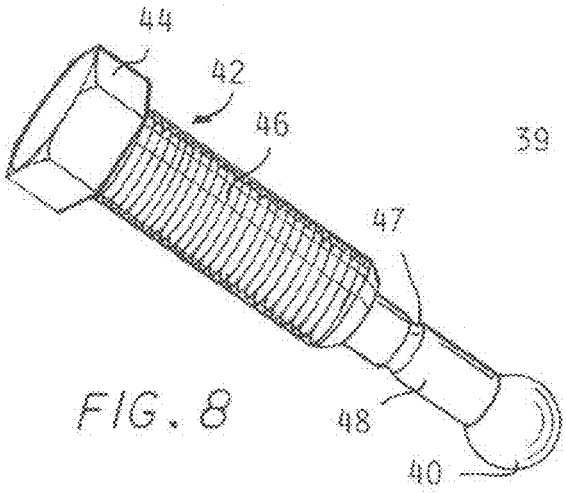
FIG. 8 is an enlarged pictorial view of the drive member shown in FIG. 7.

The channel 36 has upper sides 39 slightly converging towards each other and terminating at the upper ends to form an intervening slot 50 at the top of the channel 36. A clearance space 43 is formed to the right beyond the channel 36 to allow the main portion 46 and intermediate section 48 to pass axially along the stop member 30 without interference as the tip 40 descends along the channel 36 and the stop member 30 is cammed to the left (FIG. 7).

When the drive member 42 is rotated in the opposite direction, it moves up in the holder body 14, and the rounded upper surfaces of tip 40 engage and exert an upward camming force on the inside surfaces of the converging sides 39 of the channel 36 whereby tip 46 slidably engages and cams the stop member 22 to the right until reaching its retracted position within the holder body 14 shown in FIG. 1.

The drive member 42 is retained in the bore 20 to maintain a proper alignment of the channel 36 with the tip 40 and ensuring that drive member 42 will continuously engage channel 36 for extension and retraction of stop member 30. An arrangement to capture the member 42 is also provided as described below.

A shear pin 19 in a hole 21 are also provided. When forces are developed sufficient to shear the spin 19, the holder body 14 is allowed to pivot down about the rod 16A which motion is accommodated by the oversized hole 18B creating a clearance with rod 16B as seen in FIG. 5.

In this arrangement, with the one end 32 protruding, the cover C is allowed to rise up until the protruding end 32 (and another fixed abutment not shown engages another fixed stop on the cover C across from the mechanism 10, not shown) engages a fixed stop F on the vault structures.

This creates a peripheral gap between the cover C and the surrounding vault structure S, which allows venting of gases through the gap while not allowing the cover to completely blow free of the manhole vault and cover frame structure. This also prevents complete removal of the cover C.

Figure 5:
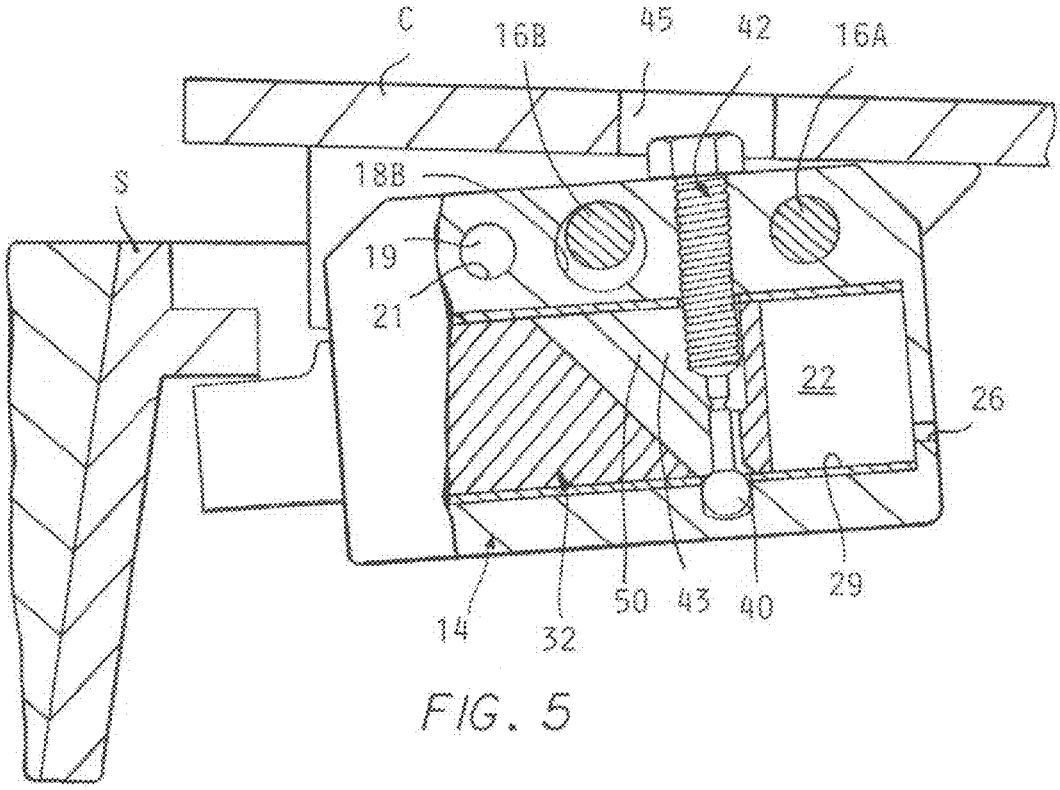
FIG. 5 is a partially sectional side view of the stop mechanism shown in FIGS. 1-4 with a shear pin released and a holder body tilted down to allow the cover to tilt up to increase the area available to vent gases.
Figure 6:
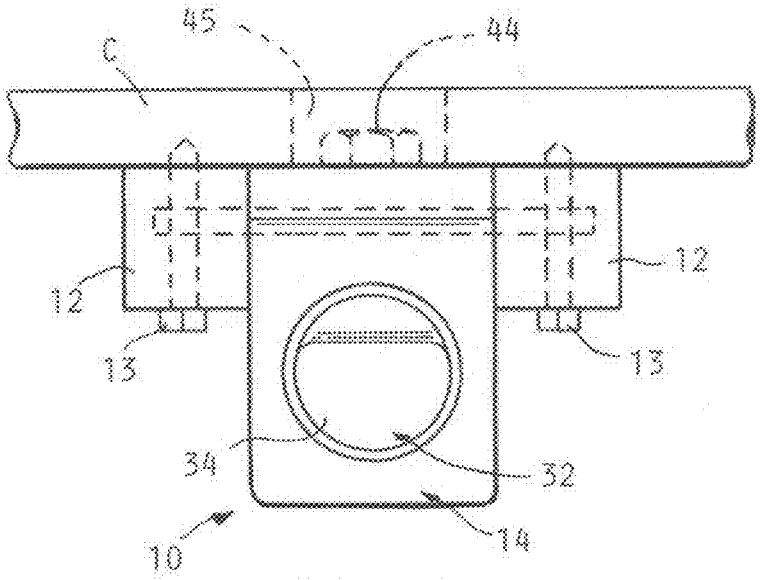
FIG. 6 is an end view of the stop mechanism showing the mounting to the underside of the cover.

In order to increase the vent area, the holder body 14 is allowed to pivot down when the shear pin 19 is stressed sufficiently to be broken, which allows tilting up of one side of the cover C as seen in FIG. 5.

The stop member 30 is able to be selectively retracted in order to install and remove the cover C.

All components of the present invention may be formed from durable and tough materials such as tough plastics, metals, and alloys thereof. Accordingly, the constituents of the present invention may be metal-formed, extruded, molded, or otherwise formed as known in the art Zinc plating of the holder body 14 and stainless steel used to form members 42 and 30 are preferred together with bars (OILITE™) bearing 29 to keep the parts moveable even after many years of exposure The stop mechanism of the present invention may also be used in other applications to facilitate security of a closed or isolated area. A particularly advantageous use is in combination with a manhole cover as described herein. It will be appreciated that the stop mechanism 10 of the present invention may be radially or otherwise oriented on a bottom surface of the manhole cover to facilitate securement as described above.

Figure 10:
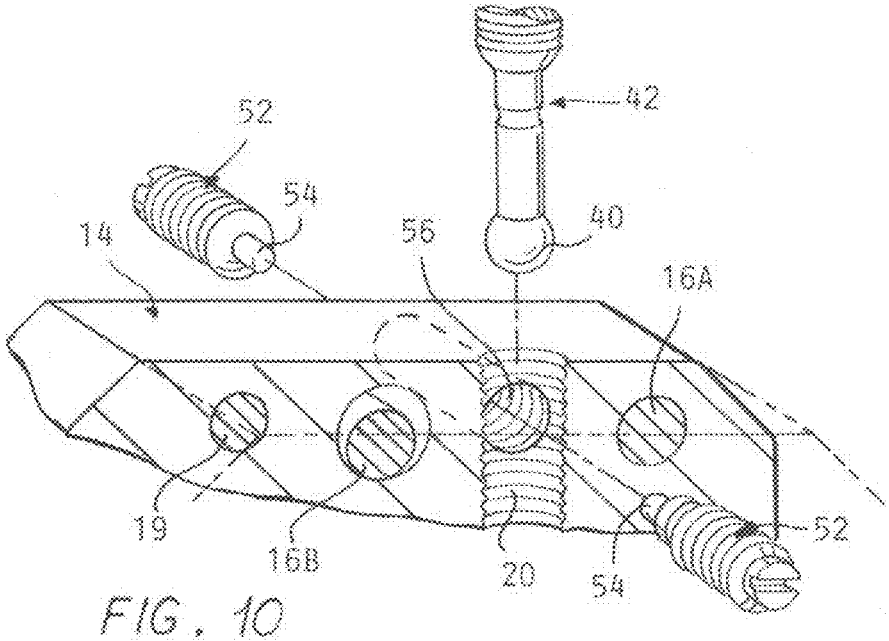
FIG. 10 is a fragmentary sectional view of the holder body and separated threaded drive member retainer elements able to engage the drive member to insure retention of the drive member in the holder body even after being disengaged with the threads in the threaded bore.

Referring to FIG. 10, a pair of threaded retainer pins 52 with spring biased plungers 54 are received in threaded holes 56 slightly offset from each other and extending into the bore 20.

The plungers 54 engage the outside of the drive member 42 while allowing its advance in for 26 when sufficiently retracted the plungers engage a groove 47 in the unthreaded section 43 and seated therein to tend to hold the member 42 in the bore 20.

This prevents the member 42 from becoming separated from the holder body 14 and perhaps from being dropped into the manhole vault.

It will be appreciated that the features of the present invention have been described in exemplary embodiments, but are subject to modification as would be recognized by one of ordinary skill in the art. Furthermore, the use of a stop mechanism in accordance with the present invention has been exemplified but not limited to securing down manhole covers. Other securement applications such as a general panel latching are also contemplated.

It should be understood that a fixed stop is affixed to the underside of the cover across from the stop mechanism as shown in U.S. Pat. No. 7,484,908 so that the cover C cannot be removed until the stop mechanism is operated.

A second mechanism according to the invention could also be installed.

The movable parts are substantially entirely enclosed so as to minimize corrosion and seizing even over a period of many years.

The invention claimed is:

1. A mechanism for preventing a cover received in an opening in a surrounding structure from being completely removed from said surrounding structure, comprising:

a holder body attached to an underside of said cover;

said holder body formed with a passage extending into said body and slidably receiving a stop member so as to be able to be moved in said passage therein between a retracted position and an extended position with one end protruding out from said body and into alignment with a fixed abutment formed on said surrounding structure to prevent said cover from being completely free of said surrounding structure;

a drive member having a threaded main portion received into a threaded bore in said holder body extending into said passage and having a tip able to be advanced into engagement with a downwardly angled surface formed on said stop member;

said stop member surface aligned with an axis of said drive member;

whereby as said drive member is advanced in said threaded bore, said stop member is cammed to said extended position.

2. The mechanism according to claim 1 wherein said drive member and said stop member have surfaces interengaged to retract said stop member by reverse rotation of said drive member.

3. The mechanism according to claim 1 wherein said downwardly angled surface partially defines a channel formed in said stop member, said channel having converging upper sides to form a slot narrower than said tip of said drive member but wider than an adjacent section of said drive member connecting said tip to said main portion thereof, said channel having a wider entry portion at an upper end able to receive said tip, whereby said tip is able to enter and engage a bottom surface of said channel;

said tip engaging said converging sides with upper surfaces thereof as said drive member is rotated so as to be withdrawn from said bore to cam and retract said stop member as said drive member is retracted out of said threaded bore.

4. The mechanism according to claim 1 wherein said stop member is substantially round in section and slidably fits into said passage which is round in section to be fit to said stop member.

5. The mechanism according to claim 1 further including an opening extending into a sidewall of said passage opposite said threaded bore and aligned therewith and configured to receive said drive member tip upon continued advance of said drive member in said threaded bore.

6. The mechanism according to claim 1 wherein said cover comprises a manhole cover and said surrounding structure comprises a manhole vault cover frame structure.

7. The mechanism according to claim 6 wherein said holder body is attached to an underside of said manhole cover.

8. The mechanism according to claim 7 wherein said fixed abutment is located spaced above said stop member one end with said stop member in said advanced position whereby said cover can rise out of said opening to a limited extent but is prevented from moving completely free of said manhole vault structure by engagement of said fixed abutment with said protruding end of said stop member.

9. The mechanism according to claim 3 wherein said channel has a rounded bottom surface engaged with a rounded bottom of said enlarged tip.

10. The mechanism according to claim 9 wherein said converging upper sides of said channel are rounded and engage rounded upper portions of said tip which has a rounded shape upon retraction of said drive member to retract said stop member.

11. The mechanism according to claim 9 wherein a slot is defined between said upper convergent sides and wherein said tip is connected to said main body with an intermediate section narrower than said slot to allow movement within said slot as said stop member is advanced in said passage.

12. The mechanism according to claim 11 wherein a clearance space is formed in said stop member beyond said channel receiving said main body portion of said drive member as said stop member is advanced in said passage.

13. The mechanism according to claim 1 further including one or more spring loaded plungers installed in a threaded hole in said holder body and engaging said drive member to tend to retain said drive member in said threaded bore after disengagement of said drive member threaded engagement in said bore.

14. The mechanism according to claim 1 further including one or more spring loaded plungers installed in a threaded hole in said holder body and engaging said drive member to tend to retain said drive member in said threaded bore after disengagement of said drive member threaded engagement in said bore wherein said drive member intermediate section has a groove engaged by said plungers upon continued withdrawal of said drive member from said bore.

15. The mechanism according to claim 1 wherein said stop member slides in a bearing sleeve defining said passage.

* * * * *